United States Patent [19]

Hugues et al.

[11] Patent Number: 4,672,723

[45] Date of Patent: Jun. 16, 1987

[54] STABILIZED RECLOSABLE EXTRUDED PLASTIC FASTENERS

[75] Inventors: Gilbert P. J. M. Hugues, Ville D'Avray, France; Steven Ausnit, New York, N.Y.

[73] Assignee: Minigrip, Inc., Orangeburg, N.Y.

[21] Appl. No.: 866,917

[22] Filed: May 27, 1986

[30] Foreign Application Priority Data

Nov. 4, 1985 [FR] France ..... 8516295

[51] Int. Cl.[4] ..... A44B 21/00; B65D 33/16

[52] U.S. Cl. ..... 24/587; 24/297; 383/63; 383/65

[58] Field of Search ..... 24/587, 588, 576, 621, 24/297; 383/63, 65, 35

[56] References Cited

U.S. PATENT DOCUMENTS

| | | | |
|---|---|---|---|
| 3,074,520 | 1/1963 | Grubelich | 24/297 |
| 3,338,284 | 8/1967 | Ausnit | 383/65 |
| 3,338,285 | 8/1967 | Jaster | 383/65 |
| 3,347,298 | 10/1967 | Ausnit et al. | 24/587 |
| 3,425,469 | 2/1969 | Ausnit | 24/587 |
| 3,679,511 | 7/1972 | Ausnit | 383/63 |
| 3,808,649 | 5/1974 | Ausnit | 383/63 |
| 3,918,131 | 11/1975 | Ausnit | 24/576 |
| 4,020,884 | 5/1977 | Jadot | 24/587 |
| 4,363,345 | 12/1982 | Scheibner | 24/587 |
| 4,484,352 | 11/1984 | Katzin | 383/65 |

FOREIGN PATENT DOCUMENTS

| | | | |
|---|---|---|---|
| 1289367 | 2/1969 | Fed. Rep. of Germany | 24/297 |
| 2133462 | 7/1984 | United Kingdom . | |

*Primary Examiner*—Victor N. Sakran

*Attorney, Agent, or Firm*—Hill, Van Santen, Steadman & Simpson

[57] ABSTRACT

A reclosable extruded plastic fastener for joining sheet material such as walls of bags, and method of making the same. The fastener comprises a grooved female profile and a complementary hook-headed male profile, and a stabilizing structure especially advantageous when pressing the profiles together into closed fastener assembly. The female profile has a generally square base with at least one stop shoulder to minimize tipping of the female profile about a thin, thermal bridge minimizing, heat transfer limiting stem. The hooked jaw arms of the female profile may have various geometric shapes. The male profile has an interhooking barb which interengages with the hooked jaws of the female profile. Stabilizing ribs are spaced from the head, but the rib at the inner side of the head is closer to the head than at the other or outer side, so that there is a desirable differential fastener separating relationship retaining the fastener efficiently with greater hold against opening due to internal bag forces.

26 Claims, 6 Drawing Figures

STABILIZED RECLOSABLE EXTRUDED PLASTIC FASTENERS

BACKGROUND OF THE INVENTION

This invention relates to the art of extruded reclosable plastic fasteners of the kind in which complementary male and female profiles are capable of elastically engaging with one another for connecting opposed panels of sheet material such as the walls of bags made from the sheet material.

Reclosable fasteners of the kind identified are well known and widely used in sacks or bags made from plastic sheet or film material, for the packaging of numerous and varied products. The profiles have complementary generally hook-shaped connecting structure and by virtue of resilient flexibility are adapted to be digitally pressed together into interlocked condition and to be digitally separated by pulling them apart. Although the profiles may be integrally extruded with the plastic sheet or film material, they may also be separately extruded and attached to the material by fused welding, adhesive attachment, or the like.

More particularly, the invention is concerned with the type of fastener comprising male and female profiles wherein the female profile is composed of a base joined to the associated sheet and of two arms joined to this base and having opposed terminal jaws directed toward the base of the profile. These two jaws are intended to cooperate with two complementary lateral projections or barbs which comprise the head of the male profile in order for the latter to remain captured by the female profile after their mutual elastic engagement. Separation of the profiles is obtained by applying relatively differential separating forces to the sheets to which the profiles are attached, depending on whether the force is being applied from inside or outside the bag formed from the sheets. Such interlocking fastener means are well known and in wide usage, being particularly employed in order to close sacks or bags of plastic material which are presently employed, particularly in industry and commerce, for the sale of products of general use such as articles of clothing, small implements, food products which are frozen or not frozen, etc.

In current technology, it is customary, among other things, to assure the juncture between the female profile and the corresponding sheet by means of a relatively large seating surface in order to prevent this female profile from tilting during the operation of engagement with the male profile. At the discharge of the extruding die and during the forced cooling phase imposed on the sheet and on the female profile, however, this large seating surface acts like a veritable thermal bridge between the sheet and the female profile and thus lends itself to transfer of material by creep between the two elements.

SUMMARY OF THE PRESENT INVENTION

An aim of the invention is to avoid these disadvantages by thermally insulating the sheet and the female profile from one another, while facilitating the interlocking engagement of the two profiles.

Another object of the present invention is to perfect this type of interlocking means in such fashion that the fabrication and use thereof are facilitated.

In particular, better cooling conditions of the product are attained at the discharge of the extruder, specifically in order to be able to extrude at a higher speed than in the past, while providing differential cooling for the female profile.

To this end, a juncture means for the female profile is essentially characterized in accord with the present invention by the following two complementary provisions:

The base of the female profile is joined to the associated sheet by a juncture stem which is relatively thin in comparison to the outside dimensions of the female profile; and at its ends, the exterior of the base comprises two shoulders projecting into close proximity to the sheet.

Joining of the base of the female profile to the associated sheet by a thin juncture stem presents the following advantages:

Heat transfer between the sheet and the female profile is significantly diminished. As a result, a great degree of independence between the cooling conditions of the sheet and those of the female profile is obtained. It is possible to cool the female profile in an adequate fashion without excessively cooling the sheet. Even with a very high extruding speed, the disadvantage of deformation of the female profile at the discharge of the extruder is practically avoided;

When, as pointed out above with respect to the prior art, the female profile is joined to the corresponding sheet by a large seating surface, it is found that as the plastic material is in a soft melt condition, the material of the sheet in the immediate proximity of the female profile has a tendency to flow toward the latter, thus significantly weakening the sheet in the proximity of the juncture to the profile. The concept of the present invention of providing the juncture between the female profile and the film by a thin stem minimizes this problem, limiting the possibilities of the material of the sheet to creep toward the profile;

In the known means, for reasons mentioned above, moreover, it has always been necessary to observe a certain balance between the dimensions of the female profile and those of the sheet. A very thin sheet, for example 1 to 1.25 mils film according to the prior structure is only capable of carrying a female profile having relatively reduced dimensions (on the order of 55 mils), as otherwise it has been impossible to obtain the correct cooling for these two elements. By contrast, in a structure in accord with the present invention one is freed from this type of constraint to a large degree and, in particular, where extremely thin sheets on the order of 1 to 1.25 mils are joined to female profiles having rather considerable dimensions (width on the order of 65 mils and up) which are far easier to manipulate.

As regards the further advantageous provision wherein the female profile comprises two shoulders at the outside ends of its base (although, as will become apparent, by modification a single shoulder may suffice), said shoulders extending to the immediate proximity of the sheet carrying the female profile, this, not withstanding the thinness of the aforementioned juncture stem, provides excellent stability to the female profile. In effect, this profile arrangement is practically incapable of pivotting around the hinge which may be created by the juncture stem, for this will be prevented by either the one or the other of the shoulders striking against the sheet. This facilitates engaging the male profile into the female profile without difficulty.

Bearing in mind all of the above-enumerated advantages, the invention can be implemented in a variety of modes.

Thus, the structure can be characterized in that the base of the female profile is practically flat and extends in a direction substantially parallel to the plane of the sheet, and in that the length of the juncture stem is such that a narrow space is reserved between the stop shoulder or shoulders of the base and the facing side of the sheet.

The shoulders mentioned above are located on at least one end of the two ends of the outside surface of the base of the female profile situated on opposite sides of the juncture stem.

When, moreover, the two arms of the female profile are straight and practically parallel to one another, being perpendicular to the base, the overall female profile has a square or approximately square exterior shape.

However, any other shape is possible wherein the outside surface of the base of the female profile carries wider shoulders capable of being supported on the sheet in order to limit all pivoting of the female profile around its juncture stem connection to the sheet.

In accord with another way of realizing the invention, the length of the juncture stem joining the base of the female profile to the corresponding sheet may be greater than the space provided between the shoulders and the sheet. Seen as a cross section, the base of the female profile will then be concave or have the shape of an open dihedron. This arrangement is also of interest, for it allows the length of the juncture stem to be substantially augmented without increasing the space between the sheet and the shoulders of the exterior surface of the base of the female profile. In this fashion, the cooling of the female profile can be further isolated during the cooling of the sheet, without diminishing the stability of this profile.

Whatever method of realization is chosen and being given that one generally wishes to obtain the same degree of stability of the female profile when rotated in either of two directions, the structure can be further characterized in that the juncture stem extends substantially along the center line of the base of said female profile. However, a female profile with an off-center stem can also be used as is discussed later.

The present invention is also concerned with means generally complementary to the female profile but relating to the structure of the male profile. In a general fashion, the male profile is composed of a head capable of penetrating into the female profile and provided with two lateral projections suitable for cooperation by mutual engagement with the two jaws of the female profile, this head being joined to the associated sheet by a foot, with the sheet having an alignment rib on either side of the male profile, with one of these ribs being closer to said foot and head of the profile than the other and being close enough so as to leave only a small interval for the passage of the end of the corresponding arm of the female profile between it and the adjacent lateral projection of the head of the male profile. Such ribs facilitate the alignment and the guidance of the male profile with respect to the female profile while somewhat stiffening the sheet in the proximity of the foot of the male profile without having to thicken the sheet at this location. These ribs are also advantageous in substantially enlarging the rigid supporting zone available to the user during the operation of the fastener means. This renders the fastener easier to handle and more reliable.

With regard to the rib that is located closer to the male profile, and which can serve to guide the corresponding arm of the female profile, it also serves to reinforce the force necessary to be on the sheets at this side of the profiles that prevents uncoupling the profiles. This provides the resulting bag with greater strength to resist opening from the inside, a very desirable feature and a substantial improvement over existing constructions.

This provision of ribs, moreover, can be combined with known arrangements having the same goal, these comprising, for example, the utilization of a head of the male profile comprising an assymetrical transverse section, with one of the aforementioned lateral projections having a greater capability than the other of catching on the corresponding jaw of the female profile. In this case, this lateral projection of the male profile having a greater capability of catching is situated at the same side as the alignment rib closer to this profile in an advantageous way and in order for these effects to add up. In this way, also, the rib under consideration, at least to a certain degree is capable of preventing granular products or the like entering between the male profile and the female profile, and possibly inhibiting the proper function thereof and even being the cause for leaks.

BRIEF DESCRIPTION OF THE DRAWINGS

Other objects, features and advantages of the present invention will be readily apparent from the following description of a representative embodiment thereof, taken in conjunction with the accompanying drawings, although variations and modification may be effected without departing from the spirit and scope of the novel concepts embodied in the disclosure, and in which.

DETAILED DESCRIPTION

Figure 1:
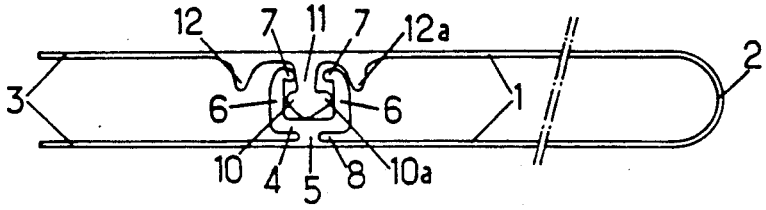
FIG. 1 is a fragmental longitudinal sectional illustrative view through a plastic bag having extruded in one piece therewith reclosable plastic fastener means embodying the present invention.

By way of example, the invention is disclosed in the several Figures in the drawings as embodied in a bag formed from extruded sheet or film material providing sidewalls 1 and closed along a bottom edge or end 2 which may be a fold as shown in FIG. 1, but which may be a heat-sealed seam if preferred such as where the bag is made from separately extruded film strip or where the film is folded above the profiles. In any event, the bag has not only the bottom end 2 closed, but also the opposite side edges closed, although the side edge closures are not shown by reason of the common practice in this regard, and in order to maintain a more open, more or less schematic, disclosure for illustrative purposes.

Figure 2:
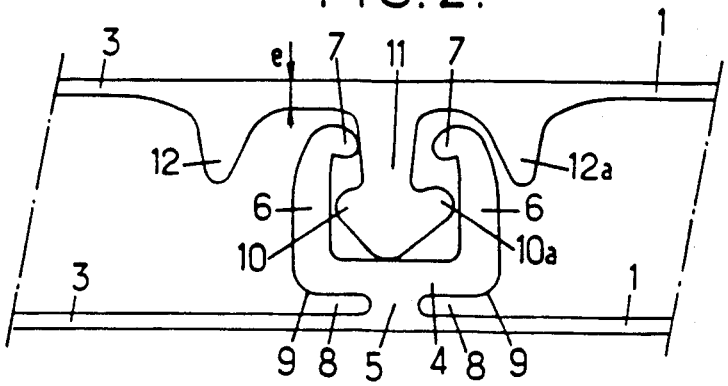
FIG. 2 is an enlarged fragmentary view of the reclosable fastener structure of FIG. 1.

At the top end of the bag, pull flanges 3 define a mouth opening. At the inner ends of the pull flange, is provided a stabilized reclosable extruded plastic fastener structure embodying the present invention and comprising on one of the walls 1 a female profile having a substantially flat base 4 joined to its companion sheet panel 1 by a thin, short and in this instance central juncture or attachment stem 5 which assures a minimal thermal transfer between the material contained in the sheet and the material contained in the profile so as to isolate these two materials from each other as much as possible, thereby to allow cooling of one with minimal effect on the cooling of the other. In a preferred construction, the female profile is of generally rectangular or box form cross section, with spaced generally parallel extending fastener arms 6 projecting from the base 4 in the opposite direction from the stem 5. Each of the arms 6 terminates in a retaining jaw or hook 7 with the hooks directed toward one another in spaced relation. As seen in FIG. 2, the hooks 7 are desirably slightly inclined toward the base 4.

A very thin or narrow space 8 is provided between the base 4 and the wall surface 1 opposite the overhanging surfaces of the base 4. At the opposite sides of the base 4, that is the respective sides extending from the stem 5, there are stabilizing shoulders 9 facing toward the adjacent sheet 1, and which are generally aligned with the arms 6. A principal function of the shoulders 9 is to serve as stops when engaging the sheet 1 thereby strictly limiting the pivoting or rocking of the female profile about the stem 5 which in turn prevents engagement-defeating lateral displacement of the female profile relative to the male profile when pressing the profiles together for fastener closing. This stabilizes the position of the female profile for the fastener closing or interlocking maneuver even though the stem 5 is as thin as practicable, so that the thermal bridge effect of the stem 5 between the profile base 4 and the film wall 1 is extremely reduced.

On the opposite wall or sheet 1, a male profile complementary to the female profile is provided, and in this instance generally of arrowhead shape having oppositely projecting interlocking barbs 10 and 10*a* generally complementary to and interlockingly interengagable with the hooks 7 facing into the groove defined between the female profile arms 6. A leg 11 joins the arrow-shaped head of the male profile to the adjacent wall 1. It will be observed that as is well known in the art the interlocking barb 10*a* is of larger mass and wider than the barb 10 and projects toward the inside of the bag, where it will cooperate with the female profile leg 6 at the inside of the bag, and afford desirable resistance against opening of the fastener due to internal pressures within the bag.

Means for facilitating alignment of the male profile with the female profile during the fastener closing maneuver, and also for effecting desirable reinforcement or rigidifying of the overall male profile, consists of alignment ribs 12 and 12*a* spaced alongside and integral with the base area of the male profile. The rib 12 is located at the mouth side of the male profile and the rib 12*a* is located at the inner side of the male profile with respect to the inside of the bag. While this also is known art, the novelty lies in placing the rib 12*a* substantially closer to the profile leg 11 than the rib 12, and thereby enhancing the resistance to the opening of the fastener from inside the bag.

As will be observed, the rib 12*a* leaves only sufficient space between it and the adjacent barb 10*a* for receiving the complementary arm 6 of the female profile between the rib 12*a* and the barb 10*a*. There is, accordingly, a good cooperation between the barb 10*a* and the rib 12*a* for rendering it more difficult for the bag to be opened from the inside than from the outside than would have been for similar profiles found in prior art. As also observed, the rib 12 toward the outer end of the bag is spaced a substantially greater distance from the adjacent barb 10 than the thickness of the complementary arm 6, so that relatively easy opening from the outside of the bag is facilitated by working the pull flanges 3.

As can also be clearly seen in FIGS. 1 and 2, the space between the ribs 12 and 12*a* is substantial relative to the width of the profile foot 11. This very noticably augments the relatively rigid seating surface available to the fingers of the user's hand when pressing the fastener closed, that is, pressing the male profile into the female profile. This is effected without significantly increasing the thickness e (FIG. 2) of the sheet 1 in the area immediately adjacent to the foot 11.

Figure 3:
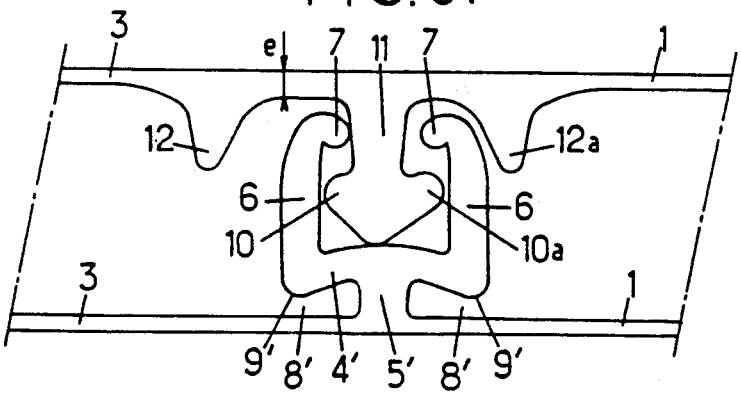
FIG. 3 is a view similar to FIG. 2, but showing a modification.

In the modification of FIG. 3, much the same structure is embodied as in FIG. 2, as will be evident. Identical reference numerals represent identical parts in the two figures so that the various parts need not be again described at this point. It will be noted that in FIG. 3, the base 4' of the female profile is, however, generally concave toward the inside of the groove provided between the arms 6, defining generally the shape of an open dihedron. The connecting stem 5' is in similar fashion as the stem 5 in FIG. 2, thin and centrally located, except that the length of the stem 5' is substantially greater than the maximum width of the space 8' defined between the associated sheet 1 and the shoulders 9'. Nevertheless, the shoulders 9' approach the sheet 1 to approximately the same spaced relation as the shoulders 9 in FIG. 2. Thus, although rocking of the female profile is minimized by the shoulders 9' to the same effect as the shoulders 9 in FIG. 2, there is an improved minimizing of transmission of heat between the sheet and the female profile in FIG. 3, while maintaining the desirable stability of this profile.

In FIGS. 4, 5, and 6, again, the male profile and its associated sheet are substantially the same as in FIGS. 2 and 3, and identical reference numerals are applied and the description given in respect to FIGS. 1 and 2 is fully adopted for FIGS. 4, 5 and 6. However, the female profiles are provided with certain variations as will be described.

Figure 4:
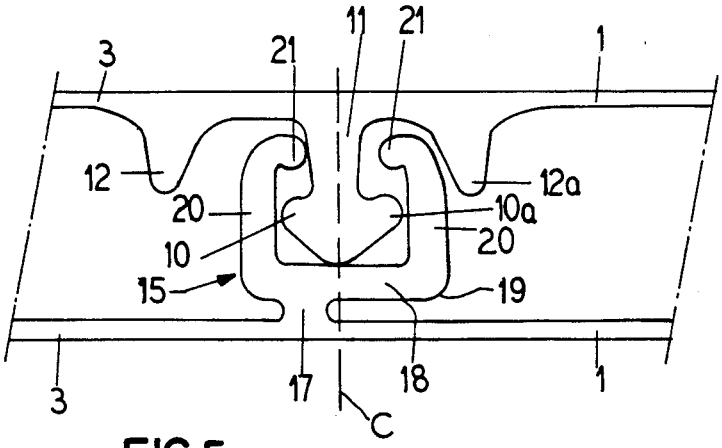
FIGS. 4, 5 and 6 are views similar to FIGS. 2 and 3, and show additional modifications.

Referring to FIG. 4, the female profile 15 has a stem 17 which, as shown, is of substantially the same short length and thinness as the stem 5 in FIG. 2, although the stem 17 may also have substantially the same geometry as the stem 5' in FIG. 3, that is, of about the same width as shown but of greater length. In either event, the profile 15 has a relatively wide base 18 which projects predominately in the direction of the inside of the bag, that is, to a greater width inwardly than to the outside of the bag. A shoulder 19 at the inner side of the base 18 is engagable with the associated sheet 1 for limiting and minimizing rocking of the profile 15. From opposite sides of the base 18, substantially parallel arms 20 project from the base 18 in direction opposite to the stem 17 and have respective confronting spaced prongs 21 which cooperate separably interlockingly with the head barbs 10 and 10' of the male profile in the closed condition of the reclosable fastener assembly. In this instance, the stem 17 is offset toward the outer end of the bag from a center line C through the male profile stem 11 and through the female profile. This is of advantage where greater resistance to opening or separation of the fastener is desired because the sheet 11 adjacent to the base 18 can deflect a substantial distance from said base 18 before placing any fastener separating strain on the female profile 15.

Figure 5:
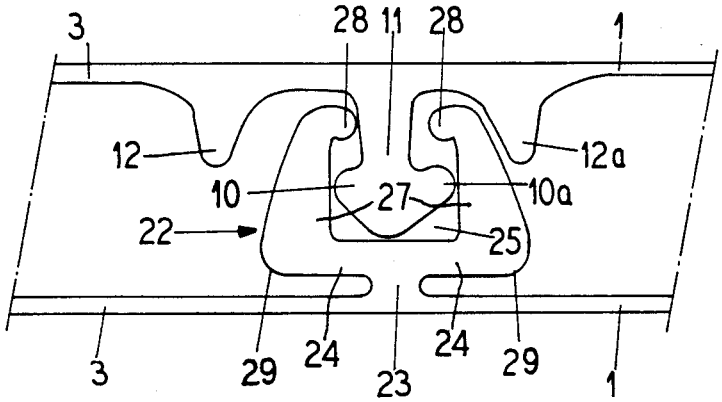

In FIG. 5, a slightly modified female profile 22 is depicted wherein a stem 23 is provided of substantially the same configuration as in FIG. 4 except that it is substantially centered relative to the male profile leg 11, similarly as in FIGS. 2 and 3. Base 24 of the female profile 22 projects laterally on either side of the stem 23 to a substantially equal distance which may be up to twice the width that is shown in the arrangement of FIG. 2. Nevertheless a groove 25 defined within the profile 22 by arms 27 may be of about the same dimensions as the groove in the female profile in FIG. 2. Generally inwardly directed hooks 28 on the arms 27 cooperate with the barbs 10 and 10*a* in similar fashion as do the hooks 7 in FIG. 2. The principal diference resides in that each of the arms 27 has a thickness at the base 24 which spaces the anti-rocking shoulders 29 to a substantially greater extent from the stem 23 than the shoulders 9 are spaced from the stem 5 in FIG. 2. From the shoulders 29, the thickness of the arms 27 tapers toward the hooks 28. An advantage gained from this construction is that the rocking range of the profile 22 is lessened, and the arms 27 are substantially stiffened. This increases the stability of the profile 22 and thus of the fastener assembly, where that may be a particular consideration.

Figure 6:
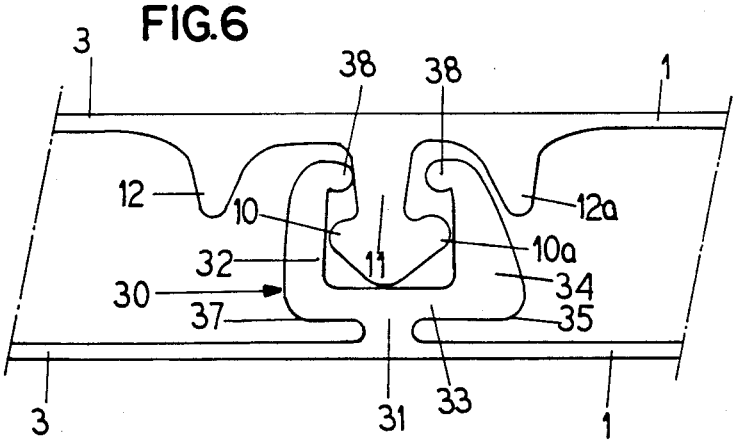

In FIG. 6 there is provided a female profile 30 which is essentially a hybrid of the structures in FIGS. 2 and 5. That is, while connecting stem 31 is substantially the same as the stem in FIGS. 2 and 5, arm 32 at the outer side of base 33, that is toward the open end of the bag, is of substantially the same structure as the arm 6 at the outer side in FIG. 2, while the arm 34 at the inner side of base 33 is of substantially the same structure as the arm 27 at either side of the profile 22 in FIG. 5. That is, the arm 34 has a substantially greater base thickness, and a shoulder 35 spaced at substantially greater distance from the stem 31 than opposite shoulder 37. Stability is good at both sides of the profile 30, but better at the inner side by virtue of the greater width on that side of the base 33, due to the spacing of the shoulder 35 from the stem 31, and the greater mass of the arm 34. Hooks 38 at the distal ends of the arms 32 and 34 function the same as the hooks 28 in FIG. 5.

From the foregoing, it will be appreciated that the present invention provides a substantially new and improved reclosable fastener structure of the interhooked tongue and groove type wherein because of the relatively thin, small mass juncture stem connecting the female profile to the associated sheet, heat transfer between the sheet and the female profile is significantly reduced, as a result of which a great degree of independence is obtained between the cooling conditions of the sheet and of the female profile. It is now possible to cool the female profile in an adequate fashion without adversely affecting the cooling of the sheet. Even with a very high extrusion speed, the disadvantage of heat transfer experienced with prior structures is significantly alleviated. Control of the female profile against deformation is substantially improved at discharge from the extruder. Flowing of the plastic material of the sheet while in a soft fused condition in proximity to the female profile is significantly alleviated and weakening of the sheet in this area is avoided.

A further substantial improvement resides in the provision of the shoulder means at the base of the female profile which extends in close proximity to the associated sheet. Therefore, notwithstanding the thinness of the stem which joins the female profile to the sheet, excellent stability against tilting is attained for the female profile. The female profile is substantially curtailed from pivoting around the relatively thin flexible hinge defined by the stem, because the shoulder or shoulders will serve as a stop by engaging with the associated sheet and greatly facilitate pressing together closing of the fastener.

Complementary to the new and improved structure of the female profile, the male profile structure has the desirable cooperative stabilizing associated parallel ribs which not only stiffen and reinforce the general area of the male profile for facilitating the pressing of the profiles together, but also facilitate guiding the male profile into engagement with the female profile. Further, the closer spacing of the rib at the inner side of the profile serves not only an advantageous guiding function, but in cooperation with the head of the male profile and the associated arm of the female profile serves to provide a desirable additional resistance to the fastener separating due to force exerted from the inside of the bag.

It will be understood that variations and modifications may be effected without departing from the spirit and scope of the novel concepts of the present invention.

We claim as our invention:

1. A reclosable extruded plastic fastener for joining sheet material such as the walls of bags, and comprising:

a grooved female profile having a broad base and a thin and relatively short stem extending from the base for connecting the base in closely spaced relation to a material sheet area, said base having at least one shoulder spaced laterally from said stem for stopping engagement with the sheet area for limiting rocking of the female profile on said stem, and groove-defining fastener arm means on and projecting away from said base and having fastener jaw hook means directed into the groove of this profile;

said stem by its short and thin structure minimizing the thermal bridge between said female profile base and said sheet for improving the differential cooling between said profile and film during extrusion;

a male profile having a barbed head complementary to and reclosably interengagable with said fastener hook means in the groove of said female profile by pressing said profiles toward one another for closing the fastener, an attachment leg for connecting the male profile head to a material sheet area, and rib structure at opposite sides of, and spaced laterally relative to said head, and the spacing of said rib structure at one side of said head being substantially closer to said head than the spacing relative to the head of the rib structure at the opposite side of the head; and said shoulder and said rib structure cooperating for facilitating fitting together of said female and said male profiles by maintaining the profiles against relative lateral displacement when pressing said profiles together for closing the fastener.

2. A fastener according to claim 1, wherein said female profile base is substantially flat and has two shoulders spaced substantially equally from said stem.

3. A fastener according to claim 1, wherein said female profile base is arched away from the associated sheet so that said stem is substantially longer than the narrow spacing of said shoulder from the adjacent sheet area.

4. A fastener according to claim 1, wherein said base of the female profile has a portion which extends to a substantially wider extent from the stem toward what will be the inside of an associated bag than said base extends to the opposite side of the stem, and said shoulder being at the extremity of the wider portion of the base.

5. A fastener according to claim 1, wherein said stem is offset from a center line through said leg of said male profile.

6. A fastener according to claim 1, wherein at least one of said female profile arm means is substantially thicker at said base than at said jaw hook means.

7. A fastener according to claim 1, wherein said male profile has barbs at its opposite sides which are adapted to interhook with the jaw hook means of the female profile, the barb at the side of said head which is to be at the inner side of a bag being wider than the opposite barb.

8. A fastener according to claim 7, wherein respective ribs are on either side of said male profile and with the rib located on the inner side of the bag being closer to said wider barb than the spacing of the rib from the other barb.

9. A reclosable extruded plastic fastener structure for joining sheet material such as the walls of bags, comprising:

a grooved female profile having a broad base and a relatively short and thin stem of minimal thermal bridge effect extending from the base and connecting the base in closely spaced relation to a sheet, said base having at least one shoulder spaced laterally from said stem and normally narrowly spaced from the sheet, for stopping engagement with the sheet for limiting the rocking of the female profile on said stem, and groove-defining fastener arms on said base projecting away from said shoulder and having jaw hooks adapted for fastener closing press-together engagement with a complementary male profile; and said shoulder when rocked from its spaced relation to the sheet into stopping engagement with the sheet maintaining the female profile against engagement-defeating lateral displacement relative to the male profile when pressing the profiles together for fastener closing.

10. A fastener structure according to claim 9, wherein said female profile is of at least 65 mils and the sheet is under 1.25 mils.

11. A fastener according to claim 9, wherein said female profile base is substantially flat has two of said shoulders spaced substantially equally from said stem.

12. A fastener according to claim 9, wherein said female profile base is arched away from the associated sheet so that said stem is substantially longer than the narrow spacing of said shoulder from the adjacent sheet.

13. A fastener according to claim 9, wherein said base of the female profile has a portion which extends to a substantially wider extent from the stem toward what will be the inside of an associated bag than said base extends to the opposite side of the stem, and said shoulder being at the extremity of the wider portion of the base.

14. A fastener according to claim 9, wherein said stem is offset from a center line through said female profile.

15. A fastener according to claim 9, wherein at least one of said female profile arm means is substantially thicker at said base than at said jaw hook means.

16. A reclosable extruded plastic fastener structure for joining sheet material such as the walls of bags, and comprising:

a male profile having a hooked head complementary to and reclosably interengagable with fastener hook means of a female profile by pressing the profiles toward one another for fastener closing, an attachment leg for connecting the male profile head to a material sheet area, and a rib structure at opposite sides of, and spaced laterally relative to said leg, the spacing of said rib structure at one side of said leg being substantially closer to said head than the spacing of said rib structure relative to said head at the opposite side of the leg; and said rib structure cooperating for stabilizing positioning of said male profile relative to the female profile by maintaining the profiles against relative lateral displacement when pressing the profiles together for fastener closing.

17. A fastener according to claim 16, wherein said male profile has barbs at its opposite sides which are adapted to interhook with the jaw hook means of the female profile, the barb at the side of said head which is to be at the inner side of a bag being wider than the opposite barb.

18. A method of making a reclosable extruded plastic fastener structure for joining sheet material such as the walls of bags, and comprising:

forming a grooved female profile with a broad base and a relatively short and thin, thermal bridge minimizing stem, extending from the base and connecting the base in closely spaced relation to a sheet;

providing said base with at least one shoulder spaced laterally from said stem and normally narrowly spaced from the sheet, for stopping engagement with the sheet and thereby limiting rocking of the female profile on said stem; providing groove-defining fastener arms on said base projecting in the opposite direction from said stem and with jaw hooks on said arms adapted for fastener closing press-together engagement with a complementary male profile; and said shoulder when rocked from its spaced relation to the sheet into stopping engagement with the sheet maintaining the female profile against engagement-defeating lateral displacement relative to the male profile when pressing the profile together for fastener closing.

19. A method according to claim 18, which comprises providing the female profile of a size at least 65 mils and providing said sheet of under 1.25 mils.

20. A method of making a fastener according to claim 18, which comprises forming said female profile base substantially flat and with two of said shoulders spaced substantially equally from said stem.

21. A method of making a fastener according to claim 18, which comprises forming said female profile base in arched fashion away from the associated sheet so that said stem is substantially longer than the closely spaced relation of said shoulder from the adjacent sheet.

22. A method of making a fastener according to claim 18, which comprises forming said base of the female profile to extend to a substantially greater width portion from the stem toward what will be the inside of an associated bag than to extend to the opposite side of the stem, and providing said shoulder to the extremity of the greater width portion of the base.

23. A method of making a fastener according to claim 18, comprising offsetting said stem from a center line through said female profile.

24. A method of making a fastener according to claim 18, comprising forming at least one of said female profile arms substantially thicker at said base than at said jaw hook means.

25. A method of making stabilized reclosable extruded plastic fastener structure for joining sheet material such as the walls of bags, and comprising:

forming a male profile having a barbed head complementary to and reclosably interengagable with jaw hook means of a female profile by pressing the profiles toward one another for fastener closing;

providing an attachment leg for connecting the male profile head to a material sheet;

providing rib structure at opposite sides of, and spaced laterally relative to, said leg;

spacing said rib structure at one side of said leg substantially closer to said head than the spacing of the rib structure from the head at the opposite side of the leg; and effecting stabilizing cooperation of said rib structure with the female profile and thereby maintaining the profiles against relative lateral displacement when pressing the profile together for fastener closing.

26. A method of making a fastener according to claim 25, which comprises forming said male profile with barbs at its opposite sides which are adapted to interhook with the jaw hook means of the female profile, and providing the barb at the side of said head which is to be at the inner side of a bag wider than the opposite barb.

* * * * *